US009027707B2

(12) United States Patent
Schierenbeck

(10) Patent No.: US 9,027,707 B2
(45) Date of Patent: May 12, 2015

(54) CONVERTIBLE SAFETY HARNESS

(75) Inventor: Alan W. Schierenbeck, Dayton, OH (US)

(73) Assignee: Honeywell International Inc., Morristown, NJ (US)

( * ) Notice: Subject to any disclaimer, the term of this patent is extended or adjusted under 35 U.S.C. 154(b) by 355 days.

(21) Appl. No.: 13/347,386

(22) Filed: Jan. 10, 2012

(65) Prior Publication Data

US 2013/0175117 A1 Jul. 11, 2013

(51) Int. Cl.

| | |
|---|---|
| ***A47L 3/04*** | (2006.01) |
| ***A62B 1/16*** | (2006.01) |
| ***A62B 35/00*** | (2006.01) |
| ***A63B 29/02*** | (2006.01) |
| ***E06C 7/18*** | (2006.01) |
| ***B61B 7/00*** | (2006.01) |

(52) U.S. Cl.

CPC ..... *A62B 35/00* (2013.01); *A62B 35/0012* (2013.01); *A62B 35/0018* (2013.01)

(58) Field of Classification Search

CPC ..... A62B 35/00; A62B 35/0018; A62B 35/0031; A62B 35/0037

USPC ..... 182/3, 4, 6, 7

See application file for complete search history.

(56) References Cited

U.S. PATENT DOCUMENTS

| | | | | | |
|---|---|---|---|---|---|
| 1,816,262 | A | * | 7/1931 | Ritter | 297/484 |
| 2,979,028 | A | * | 4/1961 | Zakely | 182/3 |
| 3,424,134 | A | * | 1/1969 | Rosenblum | 182/3 |
| 3,757,744 | A | * | 9/1973 | Pravaz | 182/3 |
| 3,783,834 | A | * | 1/1974 | Story | 119/856 |
| 4,197,816 | A | * | 4/1980 | Lusch | 182/3 |
| 4,273,215 | A | * | 6/1981 | Leggett | 182/3 |
| 4,712,513 | A | * | 12/1987 | Huppertsberg | 182/3 |
| 4,850,057 | A | * | 7/1989 | Schierenbeck | 2/328 |
| 5,203,829 | A | * | 4/1993 | Fisk et al. | 119/857 |
| 5,433,289 | A | * | 7/1995 | O'Rourke | 182/3 |
| RE35,028 | E | * | 8/1995 | Casebolt et al. | 119/857 |
| 5,531,292 | A | * | 7/1996 | Bell | 182/3 |
| 5,540,403 | A | * | 7/1996 | Standley | 244/122 B |
| 5,957,091 | A | * | 9/1999 | McDonald et al. | 119/770 |
| 6,006,700 | A | * | 12/1999 | Cox | 119/857 |
| 6,035,440 | A | * | 3/2000 | Woodyard | 2/102 |
| 6,253,874 | B1 | * | 7/2001 | Casebolt et al. | 182/3 |
| RE37,394 | E | * | 10/2001 | Woodyard | 2/102 |
| D454,986 | S | * | 3/2002 | Casebolt et al. | D29/101.1 |
| 6,405,685 | B1 | * | 6/2002 | Cox | 119/857 |
| 6,467,851 | B1 | * | 10/2002 | Mannell et al. | 297/484 |
| 6,804,830 | B2 | * | 10/2004 | Reynolds et al. | 2/69 |

(Continued)

*Primary Examiner* — Katherine Mitchell
*Assistant Examiner* — Shiref Mekhaeil
(74) *Attorney, Agent, or Firm* — Wood, Phillips, Katz, Clark & Mortimer

(57) ABSTRACT

An upper body harness portion for converting a seat-style harness to a full body harness. The upper body harness portion includes a front lower component, a rear lower component, and an upper torso component having elongated first, second and third webbings. The ends of the first and second webbings are detachably securable to opposite sides of the front and rear or side portions of the seat-style harness waist belt, respectively. The third webbing forms a closed loop which, when worn, extends over a wearer's shoulders on opposite sides of the wearer's head. First and second connectors are slidably connected to the third webbing, with the first connector also being slidably connected to the first webbing adjacent the front of a wearer and the second connector being slidably connected to the second webbing adjacent the back of a wearer.

17 Claims, 5 Drawing Sheets

(56) References Cited

U.S. PATENT DOCUMENTS

| | | | | |
|---|---|---|---|---|
| D509,627 | S * | 9/2005 | Willows et al. | D29/101.2 |
| 7,000,730 | B1 * | 2/2006 | Ostrobrod | 182/36 |
| 7,025,171 | B2 * | 4/2006 | Cox | 182/3 |
| 7,178,632 | B2 * | 2/2007 | Casebolt et al. | 182/3 |
| D556,383 | S * | 11/2007 | Petzl | D29/101.1 |
| 7,979,919 | B2 * | 7/2011 | Joran | 2/69 |
| 8,056,675 | B2 * | 11/2011 | Helms | 182/3 |
| 2006/0005293 | A1 * | 1/2006 | Frey et al. | 2/44 |
| 2008/0011545 | A1 * | 1/2008 | Turner | 182/6 |
| 2009/0127396 | A1 * | 5/2009 | Jordan | 244/151 R |
| 2009/0320188 | A1 * | 12/2009 | Johnson et al. | 2/455 |
| 2011/0101061 | A1 | 5/2011 | Schierenbeck et al. | |

* cited by examiner

CONVERTIBLE SAFETY HARNESS

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD

The present application relates to safety harnesses, and more particularly to harnesses which are adjustable and/or can be converted between a safety seat-style harness and a full body harness.

BACKGROUND

Many workers can perform their day-to-day occupational duties and comply with labor codes for fall "prevention" while wearing what is known in the fire service as a Class 2 safety seat-style harness, which has only a waist belt and leg loops.

However, occasionally the situations faced by such workers change, including facing more dangerous situations requiring a Class 3 safety full body harness, which is a full body harness with not only leg loops but full torso straps as well. For example, a worker may wear a Class 2 seat-style harness expecting to work in certain conditions but, while working, conditions may change whereby the worker needs to perform certain types of rescue operations and/or work in a different than expected area where confined space or fall "protection" is required.

Transitioning from a Class 2 seat-style harness to a Class 3 full body harness must often be done as quickly as possible, since the changed situation often means that a person could be facing additional life safety threats, in need of performing a rescue and/or in need of being rescued. Unfortunately, removing a seat-style harness and then putting on a full body harness, or even putting on a full body harness over the top of a seat-style harness, can be complex and time consuming, wasting precious rescue/work time when quite often every minute and second counts. Further, the chance of improperly donning the full body harness increases when, as is often the case, it must be done as quickly as possible in chaotic situations. If that occurs, both the person being rescued and the rescuer himself may find their life at serious risk from an incorrectly donned harness.

SUMMARY

In one aspect of the present application, an upper body harness portion usable with a seat-style harness is provided to enable conversion to a Class 3 full body harness. The upper body harness portion includes a front lower component having an elongated first webbing, a rear lower component having an elongated second webbing, and an upper torso component having an elongated third webbing. The ends of the first webbing are securable to opposite sides of the front portion of the seat-style harness waist belt, and the ends of the second webbing are securable to opposite sides of the rear portion of the waist belt. The third webbing forms a closed loop which, when worn, extends over a wearer's shoulders on opposite sides of the wearer's head. First and second connectors are slidably connected to the third webbing, with the first connector also being slidably connected to the first webbing adjacent the front of a wearer and the second connector being slidably connected to the second webbing adjacent the back or side of a wearer.

In one form of this aspect, the connectors each have an upper slot and a lower slot disposed generally horizontally when worn by an upright user, with the upper slot slidably receiving the third webbing and the lower slot of the first connector slidably receiving the first webbing and the lower slot of the second connector slidably receiving the second webbing.

In a further form, the connectors are D-rings.

In another form of this aspect, first, second and third adjusters allow a wearer to selectively adjust the length of the first, second and third webbings, respectively.

In still another form of this aspect, the seat-style harness is a Class 2 seat-style harness, and the first and second webbings are detachably securable to the waist belt. In a further form, the ends of the first and second webbings comprise snap hooks detachably connectable to rings at opposite sides of the waist belt front portion and opposite sides of the waist belt rear portion.

In another aspect, a safety harness which is convertible between Class 2 seat-style harness and Class 3 full body harness is provided, including a Class 2 seat-style harness having a waist belt and leg straps, first and second waist connectors fixed to the waist belt at substantially equal distances from the center of the waist belt front portion, and third and fourth waist connectors fixed to the waist belt. The third waist connector is a first distance from the first waist connector, and the fourth waist connector is the first distance from the second waist connector, where the first distance is such that the third and fourth waist connectors are disposed at opposite sides of a wearer's hip. A removable upper body portion has a front lower component having an elongated first webbing, a rear lower component having an elongated second webbing, and an upper torso component having an elongated third webbing. The ends of the first webbing are detachably securable to the first and second waist connectors, and the ends of the second webbing are detachably securable to the third and fourth waist connectors. The third webbing forms a closed loop whereby when worn it extends over a wearer's shoulders on opposite sides of the wearer's head. A first web connector connects the third webbing to the first webbing adjacent the front of a wearer, and a second web connector connects the third webbing to the second webbing adjacent the back of a wearer.

In one form of this aspect, the leg straps are fixed to the waist belt, and the third and fourth waist connectors are connected to the waist belt at the location where the leg straps are fixed to the waist belt.

In another form of this aspect, the first and second web connectors are slidably connected to the third webbing, the first web connector is slidably connected to the first webbing adjacent the front of a wearer and the second web connector is slidably connected to the second webbing adjacent the back of a wearer. In a further form, the first and second web connectors each have an upper and lower horizontal slot, wherein the upper slot slidably receives the third webbing, the lower slot of the first web connector slidably receives the first webbing, and the lower slot of the second web connector slidably receives the second webbing.

In still another form of this aspect, first, second and third adjusters allow a wearer to selectively adjust the length of the first, second and third webbings, respectively. In a further form, the first, second, third and fourth waist connectors comprise first, second, third and fourth rings, respectively, and the ends of the first and second webbings comprise snap hooks detachably connectable to the rings.

In another aspect, a safety harness is provided, including leg straps secured to a waist belt, a front lower component having an elongated first webbing, a rear lower component having an elongated second webbing, and an upper torso component having an elongated third webbing. The ends of the first webbing are detachably securable to opposite sides of the front portion of the waist belt, and the ends of the second webbing are detachably securable to opposite sides of the rear portion of the waist belt. The third webbing forms a closed loop whereby when worn it extends over a wearer's shoulders on opposite sides of the wearer's head. First and second connectors are slidably connected to the third webbing, with the first connector also being slidably connected to the first webbing between the first webbing ends adjacent the front of a wearer and the second connector being slidably connected to the second webbing between the second webbing ends adjacent the back of a wearer.

In one form of this aspect, the connectors each have upper and lower slots, with the upper slot slidably receiving the third webbing, the lower slot of the first connector slidably receiving the first webbing, and the lower slot of the second connector slidably receiving the second webbing. In a further form, the connectors are D-rings.

In another form of this aspect, first, second and third adjusters allow a wearer to selectively adjust the length of the first, second and third webbings, respectively.

In still another form, the first and second webbings are detachably secured to the waist belt.

Other features and advantages will become apparent from a review of the entire specification, including the appended claims and drawings.

DETAILED DESCRIPTION

Figure 1:
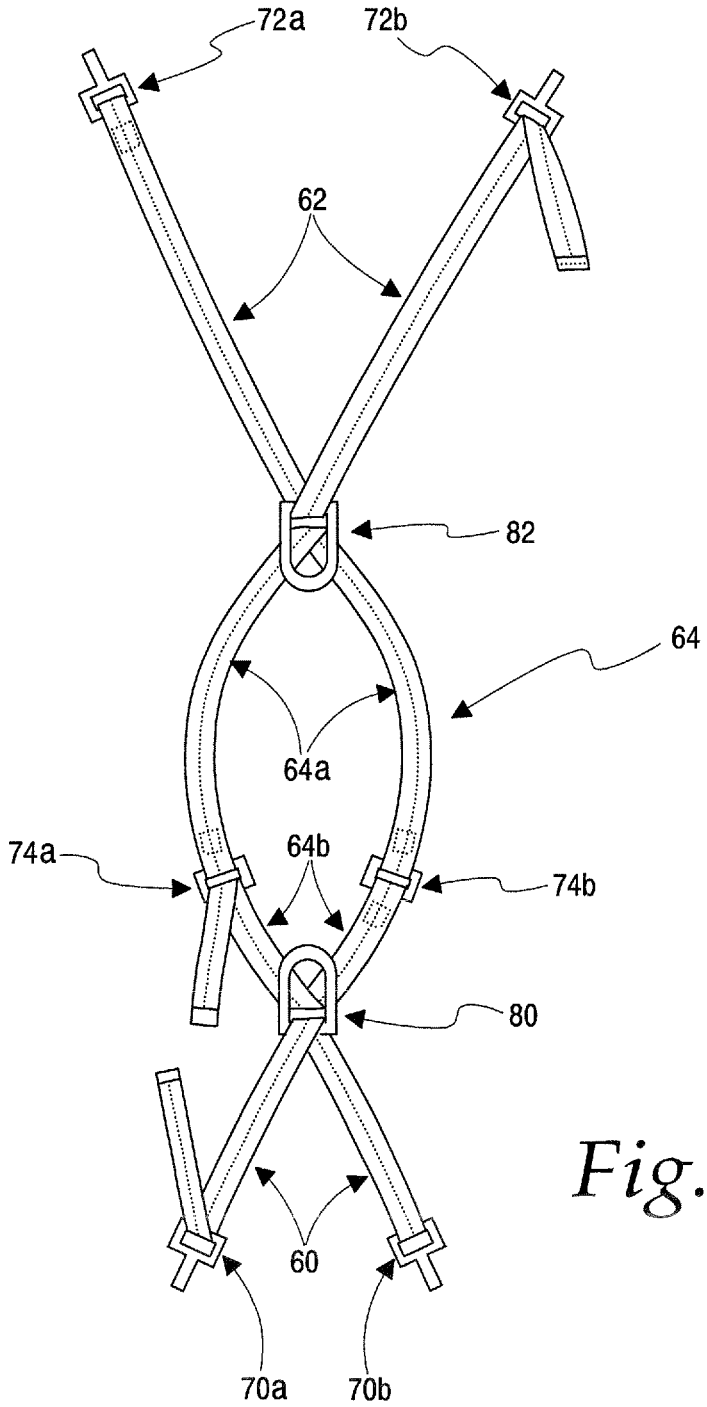
FIG. 1 is a top view of a upper body harness portion of a full body harness according to the present application, with the portion laid out flat.
Figure 2:
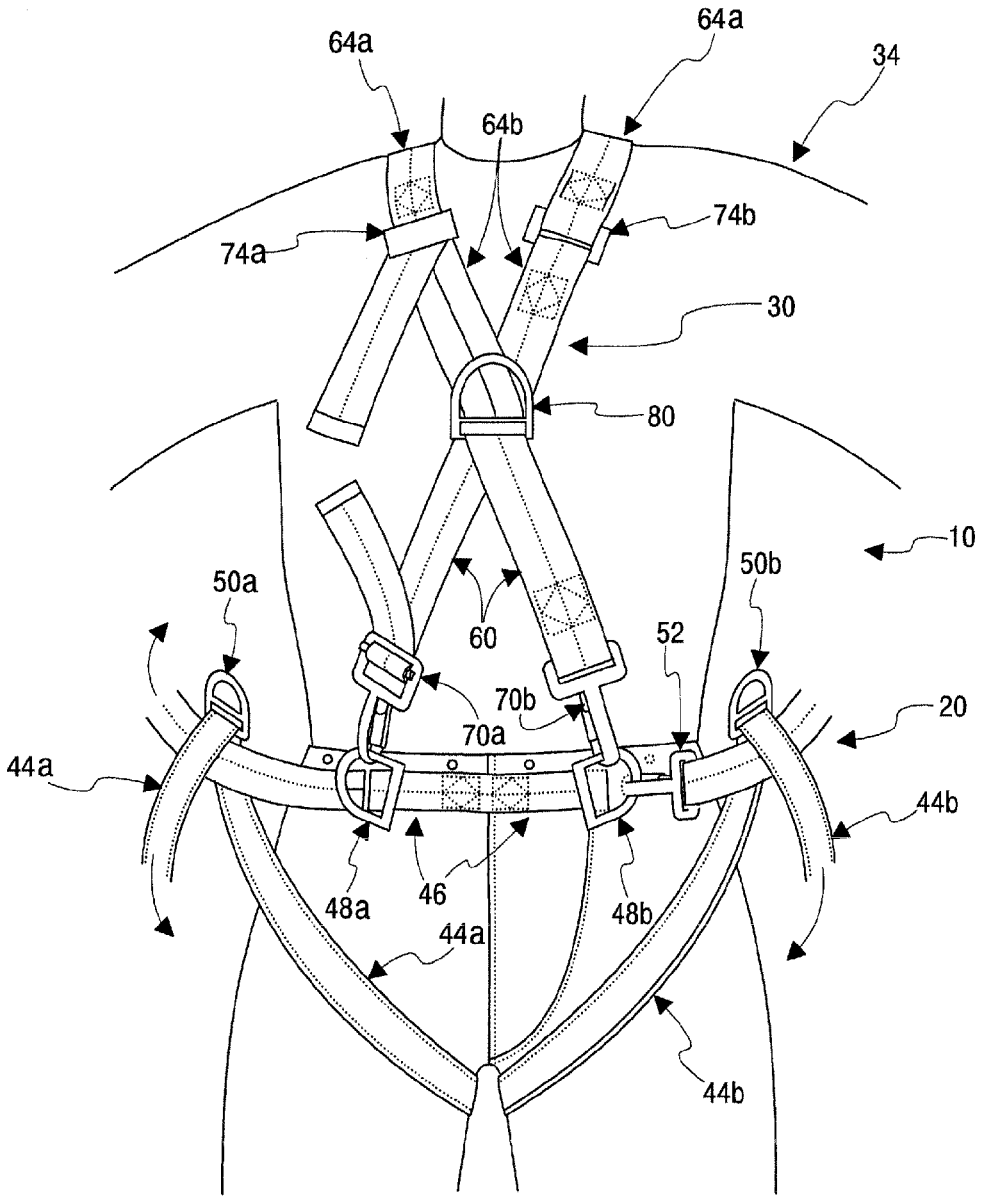
FIG. 2 is a perspective view from the front of a person wearing the full body harness of the present application.
Figure 3:
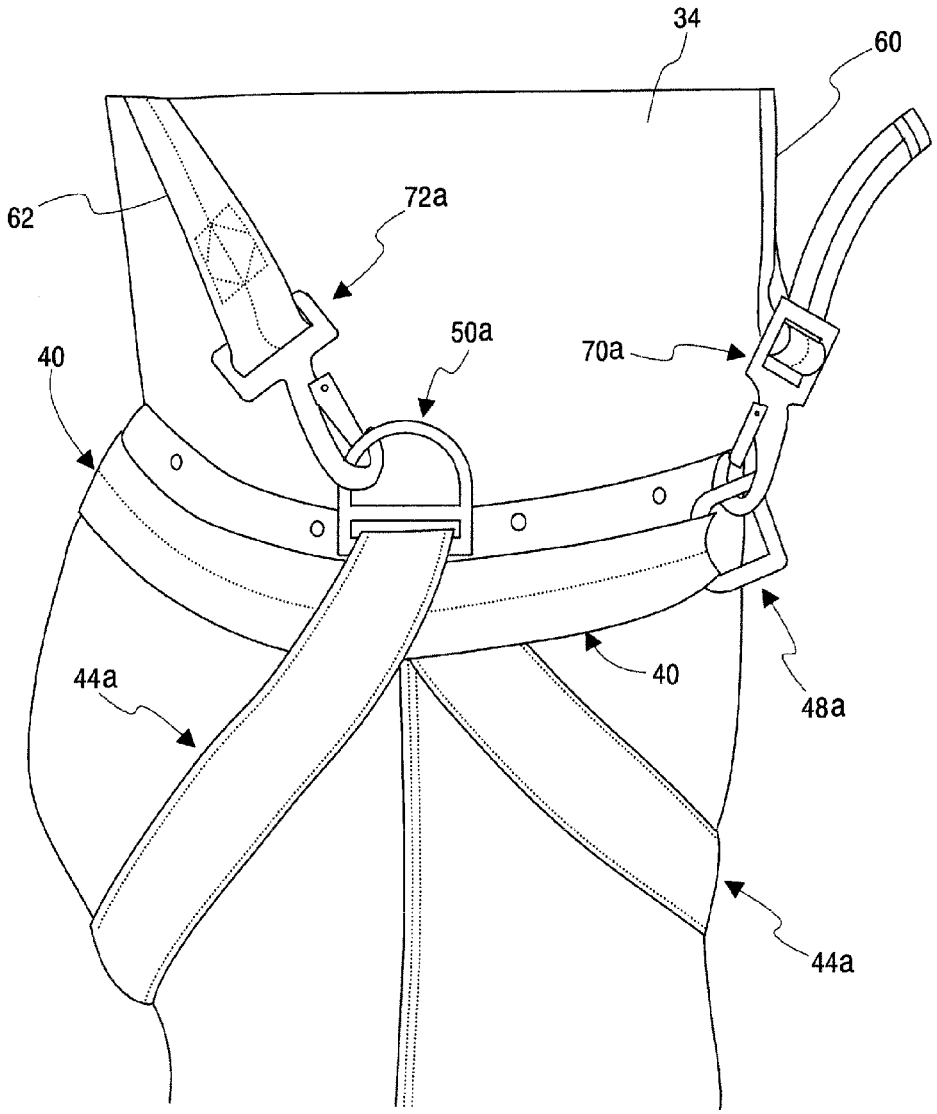
FIG. 3 is a perspective view from the right side of a person wearing the full body harness of the present application.
Figure 4:
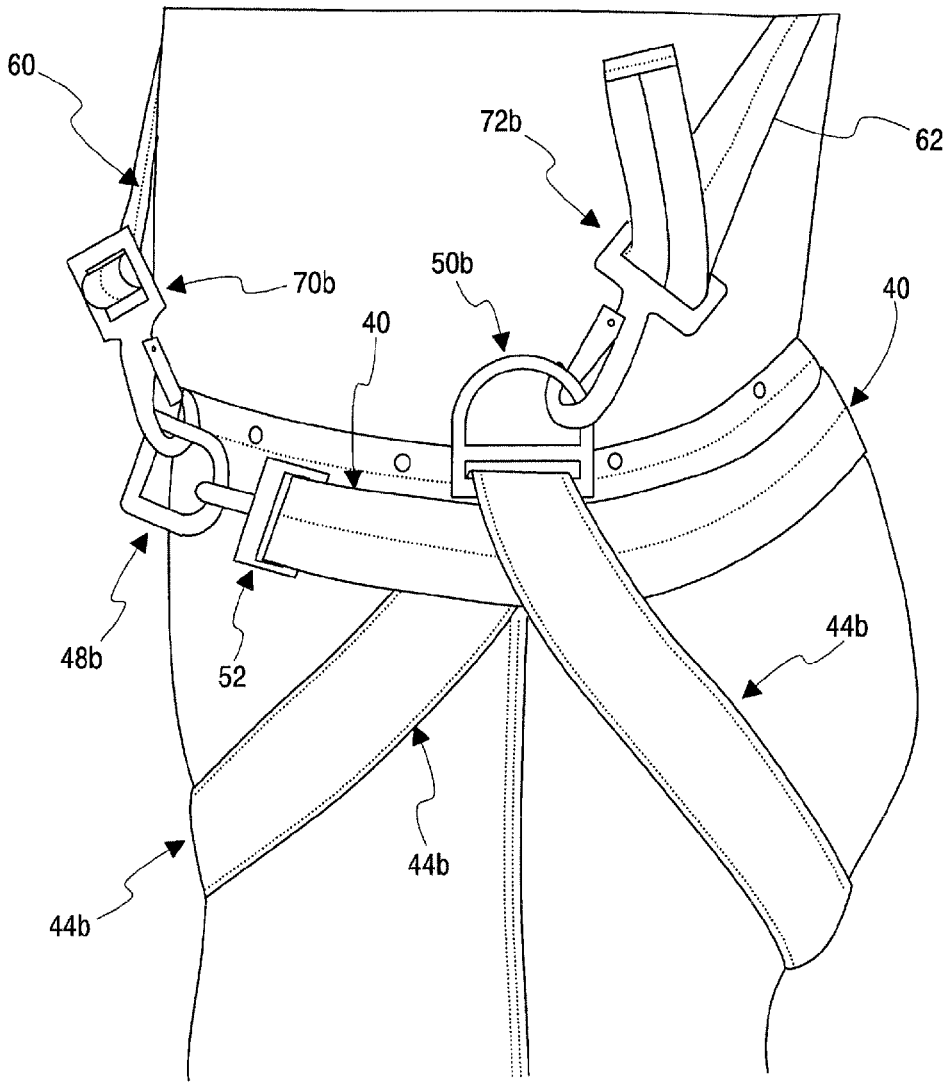
FIG. 4 is a perspective view from the left side of a person wearing the full body harness of the present application.
Figure 5:
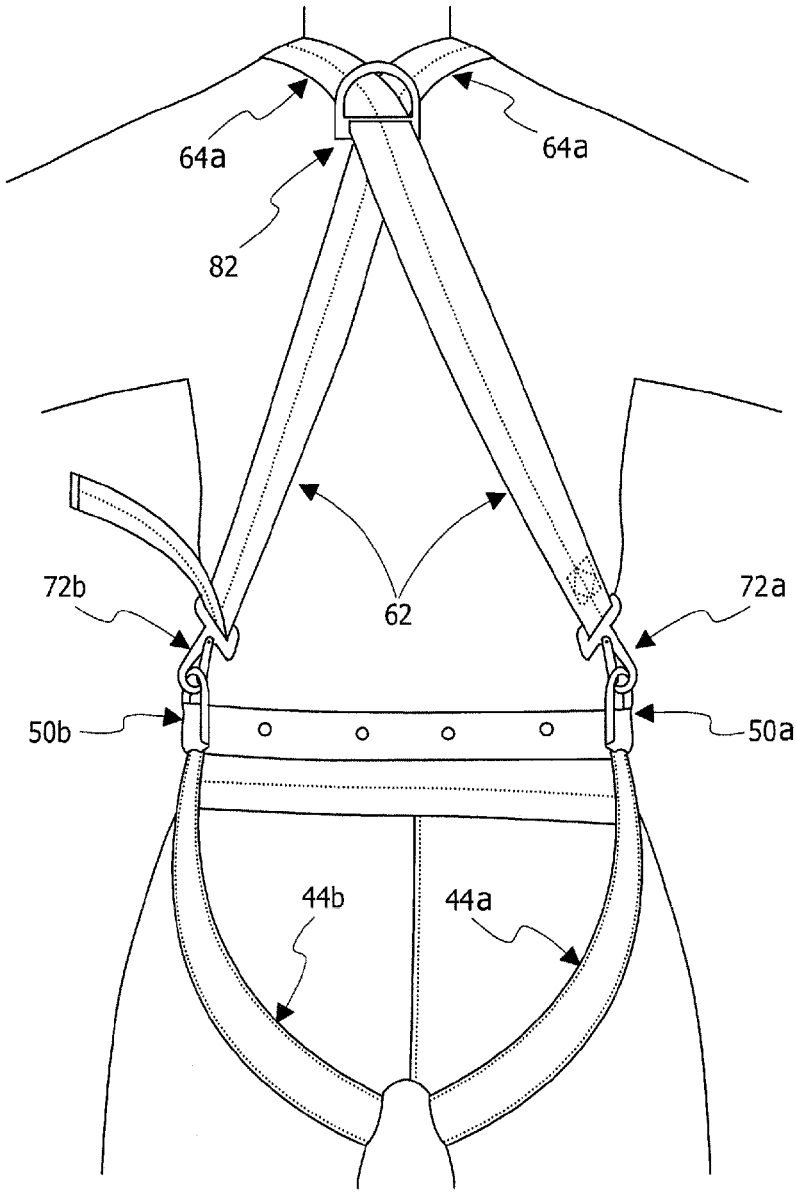
FIG. 5 is a perspective view from the back of a person wearing the full body harness of the present application.

A safety harness 10 according to the present application is illustrated in the various Figures, wherein a Class 2 seat-style harness 20 (see FIGS. 2-5) may be combined with an upper body harness portion 30 (see particularly FIG. 1) to create a full body safety harness 10 (FIGS. 2-5). The seat-style harness 20 may also be used to alone support a wearer 34 (see FIGS. 2-5) without the upper body harness portion 30 in circumstances in which Class 2 seat-style harnesses are acceptable.

The seat-style harness 20 includes a waist belt 40 having leg straps 44*a*, 44*b* suitably secured (e.g., by stitching) to the sides of the waist belt 40. The leg straps 44*a*, 44*b* are configured in a suitable fashion so that they are around the upper thighs of a wearer 34. The waist belt 40 includes a front portion 46 with suitable waist belt front connectors 48*a*, 48*b*, such as D-rings, spaced substantially equally on opposite sides of the body center line of a wearer.

Suitable waist belt side connectors 50*a*, 50*b* (again, such as D-rings) are secured to the leg straps 44 at substantially equal distances from the waist belt front connectors 48*a*, 48*b* so as to be advantageously located substantially at the side hip of a wearer (and not at the wearer's back) as detailed further hereafter. It should be appreciated, however, that some aspects of the present application could be obtained with the side connectors 50*a*, 50*b* positioned at the rear of the belt 40, adjacent the wearer's back.

Advantageously, the legs straps 44*a*, 44*b* may be folded over the waist belt 40 and pass through slots in the side connectors 50*a*, 50*b* to secure those connectors 50*a*, 50*b* at that location.

The waist belt 40 also includes a snap hook 52 which may be secured to the front connector 48*b* to close the belt 40. However, it should be appreciated that the belt 40 may be adjustable in length, and still other structures could be used for closing the belt 40 when worn by a user. Advantageously to various aspects of the application, the belt 40 should be configured with the front and side connectors 48*a*, 48*b*, 50*a*, 50*b* positioned around the wearer's waist as described above.

A wearer 34 of the seat-style harness 20 alone can be suspended in a suitable load bearing manner from connectors 48*a*, 48*b* in situations when only a Class 2 seat-style harness is required, while paired connectors 48*a*, 48*b* and 50*a*, 50*b* can be used in matched pairs as positioning attachment points in situations where only a Class 2 seat-style harness is required.

While the seat-style harness 20 described above an illustrated in FIGS. 2-5 may be used, it should be appreciated that many advantages described herein could be achieved with virtually any Class 2 seat-style harness having the necessary connection points for the upper body harness portion 30 (as described hereafter).

The upper body harness portion 30 includes three straps or webbings 60, 62, 64 forming a front lower component, a rear lower component, and an upper torso component, respectively.

Front lower webbing 60 includes suitable connectors such as snap hooks 70*a*, 70*b* on its ends which may be releasably connected to the waist belt front connectors (e.g., D-rings) 48*a*, 48*b*. Further, the webbing 60 may advantageously be adjustable in length by a suitable connection to the snap hook 70*a* whereby the wearer can, for example, pull on an end portion of the webbing to adjust the position of the snap hook 70*a* on the webbing 60. It should be appreciated that virtually any structure allowing the user to adjust the length of the webbing 60 between the end connectors (snap hooks) 70*a*, 70*b* could be used within the broad scope of some aspects of the present application, including ladder locks and clamping mechanisms.

Rear lower webbing 62 is similar to the front lower webbing 60, with suitable connectors such as snap hooks 72*a*, 72*b* on its ends which may be releasably connected to the waist belt side connectors (e.g., D-rings) 50*a*, 50*b*. Further, the webbing 62 may advantageously be adjustable in length by a suitable connection to the snap hook 70*b*. It should be appreciated that virtually any structure allowing the user to adjust the length of the webbing 62 between the end connectors (snap hooks) 72*a*, 72*b* could be used within the broad scope of some aspects of the present application, including ladder locks and clamping mechanisms.

The upper torso webbing 64 as illustrated in FIG. 1 is formed of two lengths of webbing 64*a*, 64*b*, though it should be appreciated that the webbing 64 could be formed of any number of webbing lengths, as could the front lower webbing 60 and rear lower webbing 62. In the two piece webbing 64*a*, 64*b* illustrated in FIG. 1, the separate pieces 64*a*, 64*b* are suitably connected together at each end by connectors 74*a*, 74*b*. As with the other webbings 60, 62, the length of the overall webbing 64 may advantageously be adjustable in any suitable manner, such as a ladder lock at connector 74*a*.

When the upper body harness portion 30 is secured to the seat-style harness 20 as illustrated in FIGS. 2-5, it can be seen that the webbing 64 forms a closed loop which extends over a wearer's shoulders on opposite sides of the wearer's head.

Front and rear connectors 80, 82 connect the front lower and rear lower webbings 60, 62 to the upper torso webbing 64. Specifically, each connector 80, 82 includes a pair of parallel slots therein which are at least as wide as the width of the associated webbings 60, 62, 64. The webbings 60, 62, 64 are not fixed to the connectors 80, 82 but rather pass through those slots and fold over in a "V" configuration, so that they may slide within the slots. The connectors 80, 82 may also include a D-ring portion to which a line may be secured for supporting a wearer 34 of the harness 10.

It should be appreciated that a seat-style harness 20 such as described herein may be comfortably worn where required in particular situations.

Moreover, when the situation changes whereby the wearer needs a Class 3 full body harness, rather than being forced to don a complete full body harness (either over the Class 2 seat-style harness, or after taking off the Class 2 seat-style harness), with the attendant delay and risk of error in donning the full body harness in frequently hurried and chaotic situations, the wearer may instead quickly and easily convert to a Class 3 full body harness 10 by donning the upper body harness portion upper body harness portion 30.

This may be easily and quickly accomplished by simply putting the loop of the upper torso webbing 64 over the wearer's head and then connecting the snap hooks 70*a*, 70*b*, 72*a*, 72*b* to the waist belt front and side connectors 48*a*, 48*b*, 50*a*, 50*b*. Further, it should be appreciated that by locating the connectors 50*a*, 50*b* at the wearer's side as described herein, the wearer does not need to attempt to make a connection at his back where it might be difficult to reach, but instead can reliably make all four connections himself without requiring the assistance of another person.

Adjustment for comfort and fit to the wearer 34 may similarly be quickly and easily accomplished by adjusting each of the three webbings 60, 62, 64 at the connectors 70*a*, 72*b*, 74*a*. Where the adjustment mechanism is a ladder lock such as illustrated, this may be easily accomplished by simply pulling the ends of the webbings 60, 62, 64. It should be appreciated that such adjustment allows the harness 10 and the upper body harness portion 30 to essentially be "one size fits all", thereby avoiding situations where conversion to a Class 3 full body harness is needed in a hurry but the harness available to the wearer turned out to be the wrong size (or requires extensive, time consuming adjustment to fit).

Still further, it should be appreciated that the sliding connection of the webbings 60, 62, 64 at the connectors 80, 82 results in an upper body harness portion 30 which self adjusts with movement of the wearer. For example, without the sliding connection of the webbings 60, 62, 64, if the wearer 34 illustrated in FIG. 2 were to lean to the left (his right) at his hip, the upper torso webbing 64 over his right shoulder would loosen and the upper torso webbing 64 over his left shoulder tighten and restrict the upper movement of the left shoulder occurring when he leans in that direction. However, with the present harness, the upper torso webbing 64 will slide through the connectors 80, 82 to effectively cause the length between connectors 80, 82 over his left shoulder to lengthen and cause the length between connectors 80, 82 over his right shoulder to shorten, keeping an even pressure on each shoulder and resulting in a comfortable and snug fit as the wearer moves.

Moreover, it should be appreciated that the disclosed structure has not only provided the above described advantages, but it has done so while meeting industry testing standards, including support of weights falling from a height (drop tests) as well as supporting dead weight over a specified period of time (static load tests), at both the sternal and shoulder blade load-bearing attachment points with the harness 10 tested in both the upright and inverted positions.

Although an embodiment and variations have been described in detail above, it should be appreciated that still other modifications are possible. For example, the connections depicted in the Figures may be of different configurations than shown while still achieving desirable results. Other structural elements may be provided, or elements may be eliminated, from the described structure, and other components may be added to, or removed from, the described structure. Other embodiments may be within the scope of the following claims.

The invention claimed is:

1. An upper body harness portion usable with a lower torso and leg safety harness to provide a Class 3 full body harness, said lower torso and leg safety harness having a waist belt and leg straps with said waist belt having a front portion and a rear portion, said upper body harness portion comprising:

a front lower component having an elongated first webbing, wherein said first webbing is a single unitary unbroken webbing, one end of said first webbing being securable to one side of said front portion of said waist belt and the other end of said first webbing being securable to the other side of said front portion of said waist belt;

a rear lower component having an elongated second webbing, wherein said second webbing is a single unitary unbroken webbing, one end of said second webbing being securable to one side of said rear portion of said waist belt and the other end of said second webbing being securable to the other side of said rear portion of said waist belt;

an upper torso component having an elongated third webbing, said third webbing forming a closed loop whereby the third webbing when worn extends over a wearer's shoulders on opposite sides of the wearer's head; and first and second connectors slidably connected to said third webbing, said first connector also being slidably connected to said first webbing adjacent the front of a wearer and said second connector being slidably connected to said second webbing adjacent one of the back or side of a wearer.

2. The upper body portion of claim 1, wherein the connectors each have an upper slot and a lower slot disposed generally horizontally when worn by an upright user, with the upper slot slidably receiving the third webbing and the lower slot of the first connector slidably receiving the first webbing and the lower slot of the second connector slidably receiving the second webbing.

3. The upper body portion of claim 2, wherein the connectors are D-rings.

4. The upper body portion of claim 1, further comprising first, second and third adjusters allowing a wearer to selectively adjust the length of the first, second and third webbings, respectively.

5. The upper body portion of claim 1, wherein said lower torso and leg safety harness is a Class 2 seat-style harness, and the first and second webbings are detachably securable to the waist belt.

6. The upper body portion of claim 5, wherein the ends of the first and second webbings comprise snap hooks detachably connectable to rings at opposite sides of said waist belt front portion and opposite sides of said waist belt rear portion.

7. A safety harness convertible between Class 2 seat-style harness and Class 3 full body harness, comprising:

a Class 2 seat-style harness having a waist belt and leg straps, said waist belt having a front portion and a rear portion, first and second waist connectors fixed to said waist belt at substantially equal distances from the center of said waist belt front portion;

third and fourth waist connectors fixed to said waist belt, wherein said third waist connector is a first distance from the first waist connector, said fourth waist connector is said first distance from the second waist connector, and said first distance is such that said third and fourth waist connectors are disposed at opposite sides of a wearer's hip; and a removable upper body portion having a front lower component having an elongated first webbing, wherein said first webbing is a single unitary unbroken webbing, one end of said first webbing being detachably securable to the first waist connector and the other end of said first webbing being detachably securable to the second waist connector, a rear lower component having an elongated second webbing, wherein said second webbing is a single unitary unbroken webbing, one end of said second webbing being detachably securable to said third waist connector and the other end of said second webbing being detachably securable to the fourth connector;

an upper torso component having an elongated third webbing, said third webbing forming a closed loop whereby the third webbing when worn extends over a wearer's shoulders on opposite sides of the wearer's head, a first web connector connecting said third webbing to said first webbing adjacent the front of a wearer, and a second web connector connecting said third webbing to said second webbing adjacent the back of a wearer.

8. The safety harness of claim 7, wherein said leg straps are fixed to said waist belt, and said third and fourth waist connectors are connected to said waist belt at the location where the leg straps are fixed to said waist belt.

9. The safety harness of claim 7, wherein said first and second web connectors are slidably connected to said third webbing, said first web connector also being slidably connected to said first webbing adjacent the front of a wearer and said second web connector also being slidably connected to said second webbing adjacent the back of a wearer.

10. The safety harness of claim 9, wherein the first and second web connectors each have an upper slot and a lower slot disposed generally horizontally when worn by an upright user, wherein the upper slot slidably receives the third webbing, the lower slot of the first web connector slidably receives the first webbing, and the lower slot of the second web connector slidably receives the second webbing.

11. The safety harness of claim 7, further comprising first, second and third adjusters allowing a wearer to selectively adjust the length of the first, second and third webbings, respectively.

12. The safety harness of claim 11, wherein the first, second, third and fourth waist connectors comprise first, second, third and fourth rings, respectively, and the ends of the first and second webbings comprise snap hooks detachably connectable to said rings.

13. A safety harness, comprising;

leg straps secured to a waist belt, said waist belt having a front portion and a rear portion;

a front lower component having an elongated first webbing, wherein said first webbing is a single unitary unbroken webbing, one end of said first webbing being secured to one side of said front portion of said waist belt and the other end of said first webbing being secured to the other side of said front portion of said waist belt;

a rear lower component having an elongated second webbing, wherein said second webbing is a single unitary unbroken webbing, one end of said second webbing being secured to one side of said rear portion of said waist belt and the other end of said second webbing being secured to the other side of said rear portion of said waist belt;

an upper torso component having an elongated third webbing, said third webbing forming a closed loop whereby the third webbing when worn extends over a wearer's shoulders on opposite sides of the wearer's head; and first and second connectors slidably connected to said third webbing, said first connector also being slidably connected to said first webbing between the first webbing ends adjacent the front of a wearer and said second connector being slidably connected to said second webbing between the second webbing ends adjacent the back of a wearer.

14. The safety harness of claim 13, wherein the connectors each have an upper slot and a lower slot disposed generally horizontally when worn by an upright user, with the upper slot slidably receiving the third webbing and the lower slot of the first connector slidably receives the first webbing and the lower slot of the second connector slidably receives the second webbing.

15. The safety harness of claim 13, wherein the connectors are D-rings.

16. The safety harness of claim 13, further comprising first, second and third adjusters allowing a wearer to selectively adjust the length of the first, second and third webbings, respectively.

17. The safety harness of claim 13, wherein the first and second webbings are detachably secured to the waist belt.

* * * * *